US006571538B2

(12) United States Patent
Luby

(10) Patent No.: US 6,571,538 B2
(45) Date of Patent: Jun. 3, 2003

(54) BOX FLAP SECURING DEVICE

(75) Inventor: James H. Luby, Oklahoma City, OK (US)

(73) Assignee: Afton Enterprises, Inc., Oklahoma City, OK (US)

( * ) Notice: Subject to any disclaimer, the term of this patent is extended or adjusted under 35 U.S.C. 154(b) by 0 days.

(21) Appl. No.: 09/741,991

(22) Filed: Dec. 20, 2000

(65) Prior Publication Data

US 2001/0002678 A1 Jun. 7, 2001

Related U.S. Application Data

(63) Continuation of application No. 09/039,734, filed on Mar. 16, 1998, now abandoned.

(51) Int. Cl.[7] ..... B65D 43/08; B05C 19/00

(52) U.S. Cl. ..... 53/416; 292/288; 229/125.23

(58) Field of Search ..... 53/416; 292/288; 229/125.39

(56) References Cited

U.S. PATENT DOCUMENTS

| | | | |
|---|---|---|---|
| 2,435,397 | A | 2/1948 | Lang |
| 3,221,977 | A | 12/1965 | Pollert |
| 3,276,663 | A | 10/1966 | Falconer |
| 3,545,801 | A | 12/1970 | Barsness |
| 4,761,935 | A | 8/1988 | King et al. |
| 5,516,036 | A | 5/1996 | Maultasch et al. |
| 5,702,135 | A | 12/1997 | Burress |

OTHER PUBLICATIONS

Parmley, Robert O.; "Standard Handbook of Fastening and Joining"; 3 pgs.

*Primary Examiner*—William Hong
(74) *Attorney, Agent, or Firm*—Dunlap, Codding & Rogers, P.C.

(57) ABSTRACT

A box flap securing device for securing two opposing box flaps in a closed position wherein the box flap securing device includes a bottom member having an edge, a top member disposed a distance from the bottom member and in an overlying relationship with the bottom member, and a post interconnecting the bottom member and the top member. The post has an edge which is disposed in a coextensive relationship with at least a portion of the edge of the bottom member whereby the bottom member, top member and post cooperate to define a box flap receiving slot having a height at least equal to the thickness of the box flap but less than two times the thickness of the box flap.

5 Claims, 4 Drawing Sheets

BOX FLAP SECURING DEVICE

This is a continuation of application no. 09/039,734 filed Mar. 16, 1998 now abandoned.

CROSS-REFERENCE TO RELATED APPLICATION

Not applicable.

STATEMENT REGARDING FEDERALLY SPONSORED RESEARCH OR DEVELOPMENT

Not applicable.

BACKGROUND OF THE INVENTION

Many prior art standard boxes currently exist. These boxes are often and widely reused, for example, by homemakers, retailers, and others for storage and shipment of miscellaneous materials. These boxes typically include four box flaps extending inwardly from opposite upper edges of the box. The box flaps are folded inwardly along opposite edges of the box so that inward edges of opposite box flaps meet in a central location near the top of the box when the box flaps are disposed in a closed position. The boxes are typically manufactured of a material, such as corrugated cardboard, which has a memory so that the box flaps attempt to move apart unless maintained in the closed position by tape, staples or string, for example. However, taping, stapling, or tying the box flaps to maintain same in the closed position can be difficult, time consuming, ineffective and otherwise undesirable.

What is needed is an effective yet simple and inexpensive device for readily maintaining the box flaps of the box in the closed position. It is to such an improved box flap securing device to which the present invention is directed.

BRIEF SUMMARY OF THE INVENTION

In accordance with the present invention, an effective, yet relatively simple and inexpensive box flap securing device is provided for securing two opposed box flaps extending inwardly from opposite edges of the box in a closed position.

Broadly, the box flap securing device includes a substantially planar bottom member having an edge, and a substantially planar top member. The top member is spaced a distance substantially corresponding to the thickness of one box flap from the bottom member, and the top and bottom members are disposed in an overlying, substantially parallel relationship. A portion of the top member extends outwardly a distance past the edge of the bottom member.

A post connects the top member to the bottom member. A portion of the post is disposed in a coextensive relationship with at least a portion of the edge of the bottom member whereby the bottom member, top member and post cooperate to define a box flap receiving slot sized to receive one of the box flaps of the box.

In use, one of the box flaps is inserted into the box flap receiving slot until the edge of the inserted box flap engages the post and the edge of the bottom member is disposed substantially parallel with the edge of the inserted box flap. The box flap inserted into the box flap receiving slot of the box flap securing device and the box flap securing device are then moved inwardly and downwardly towards a closed position whereby an opposed box flap is disposed below the portion of the top member extending outwardly a distance from the bottom member. The portion of the top member extending outwardly a distance from the bottom member engages the opposed box flap as the box flap inserted into the box flap receiving slot of the box flap securing device and the box flap securing device are moved towards the closed position such that the continued movement towards the closed position causes the two opposed box flaps and the box flap securing device to be moved to the closed position whereby the opposed box flaps are disposed in a substantially co-planar relationship and are separated by the post interconnecting the top member and the bottom member. Once the pair of box flaps are disposed in the closed position, the box flap securing device is then selectively rotated to a locked position whereby the opposed box flaps are both disposed in the box flap receiving slot to lock the box flaps in the closed position.

In one aspect of the present invention, the post is provided with a rectangular cross-section. The rectangular cross-section causes the post to frictionally engage the opposing box flaps disposed within the box flap receiving slot to provide resistance to undesired rotation of the box flap securing device. This resistance in effect provides the box flap securing device with a "child proof" locking device to prevent children from obtaining access to the interior of the box. The rectangular post also prevents the inadvertent turning of the box flap securing device from the locked position to an unlocked position whereby only the inserted box flap is disposed in the box flap receiving slot.

In yet another aspect of the present invention, the bottom member and the top member are spaced a distance apart which is greater than the thickness of one box flap, yet which is less than two times the thickness of the one box flap. In this embodiment, the particular spacing between the top member and the bottom member prevents the device from being utilized to directly connect more than two opposing box flaps. This particular spacing is also helpful in providing a thin and compact box flap securing device so that boxes which are closed by respective box flap securing devices can be easily stacked one on top of the other.

Other features and advantages of the present invention are present from the following detailed description when read in conjunction with the accompanying drawings and appended claims.

DETAILED DESCRIPTION OF THE SEVERAL VIEWS OF THE DRAWING

Figure 1:
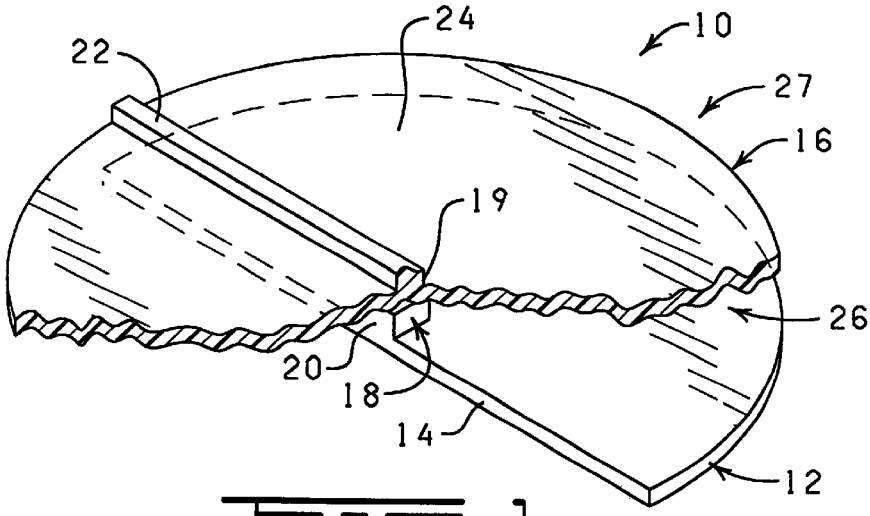
FIG. 1 is a perspective view of a box flap securing device constructed in accordance with the present invention.

Referring now to the drawings, and in particular to FIG. 1, shown therein is a box flap securing device 10 constructed in accordance with the present invention. The box flap securing device 10 is provided with a semi-circularly shaped, substantially planar or disc-like bottom member 12 having a substantially planar edge 14, and a circularly shaped, substantially planar or disc-like top member 16. A post 18 is provided to interconnect the bottom member 12 to a substantially central portion 19 of the top member 16.

The top member 16 is spaced a distance from the bottom member 12 and the top and bottom members 16 and 12 are maintained in a substantially parallel relationship by the post 18. The post 18 is provided with an outer edge 20 which is disposed about coextensive with a portion of the edge 14 of the bottom member 12.

A gripping device 22, such as a ridge, is provided on a top surface 24 of the top member 16 to permit one to grip the gripping device 22 with only their fingertips, for example, to facilitate selective rotation of the box flap securing device 10 as will be discussed hereinafter.

The bottom member 12, the top member 16 and the post 18 cooperate to define a box flap receiving slot 26, for a purpose to be described hereinafter. As shown in FIG. 1, the top member 16 overlies the bottom member 12, and also extends outwardly past the edge 14 of the bottom member 12 in a direction generally opposite from an entrance 27 of the box flap receiving slot 26, substantially as shown.

Figure 4:
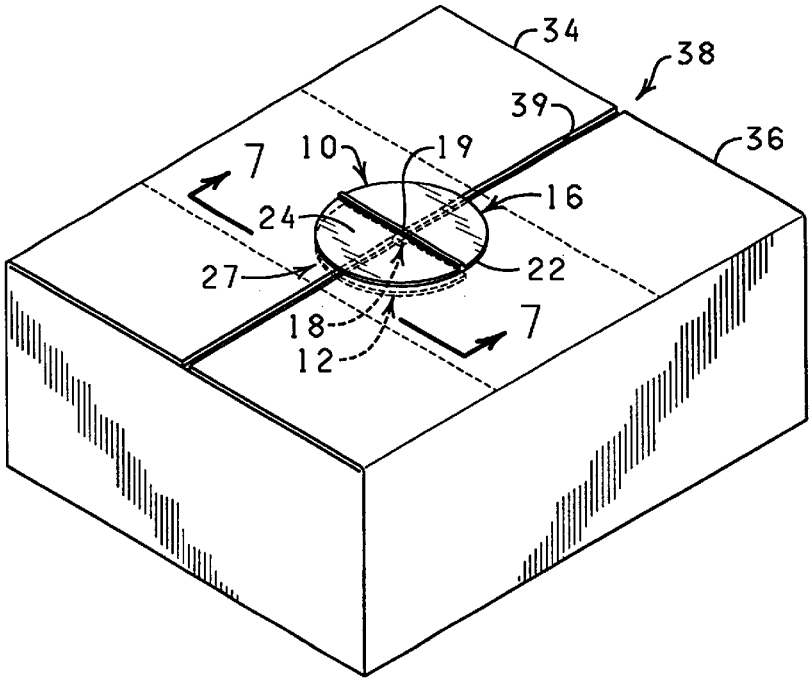
FIG. 4 is a perspective view which is identical to that depicted in FIG. 3, except that the box flap securing device has been rotated about 90° to secure the two opposing box flaps of the box in the closed position.
Figure 5:
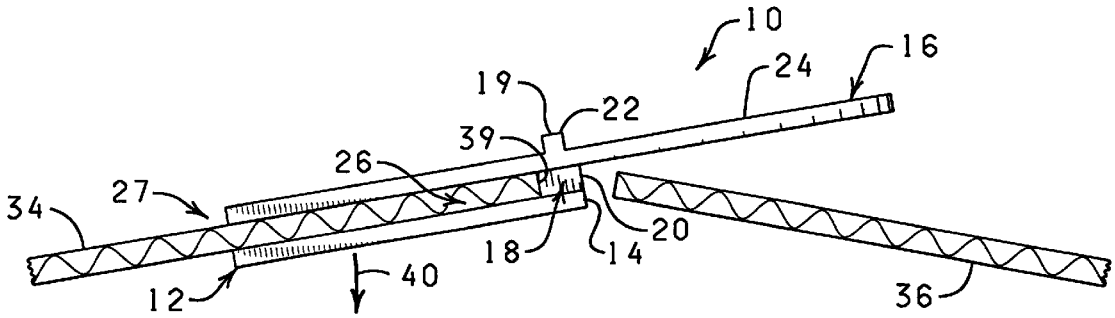
FIG. 5 is a partial, side elevational view of one of the pair of opposing box flaps disposed in the box flap receiving slot of the box flap securing device of FIG. 1 so as to illustrate a method of closing the two opposing box flaps.
Figure 6:
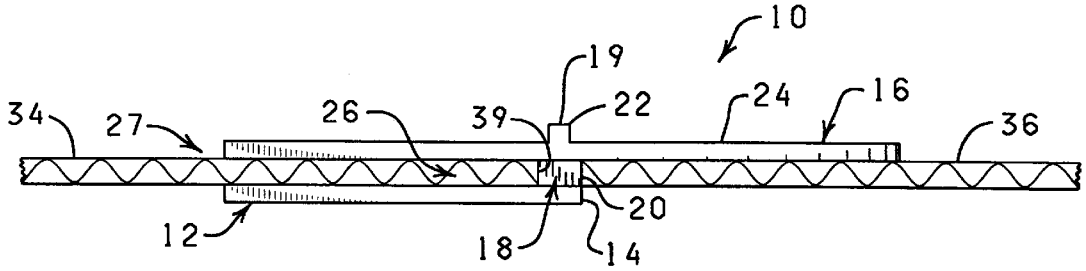
FIG. 6 is a cross-sectional view of the box flaps having the box flap securing device disposed thereon, taken along the lines 6—6 depicted in FIG. 3.
Figure 7:
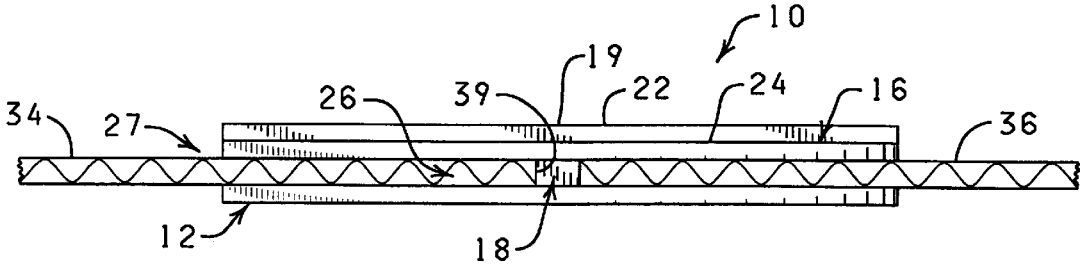
FIG. 7 is a cross-sectional view of the box flaps having the box flap securing device disposed thereon, taken along the lines 7—7 depicted in FIG. 4.

A method for securing two opposing box flaps 34 and 36 of a box 38 in a closed position will now be described with reference to FIGS. 2–7. As shown in FIGS. 5–7, the box 38 can be constructed of corrugated cardboard, for example.

Figure 2:
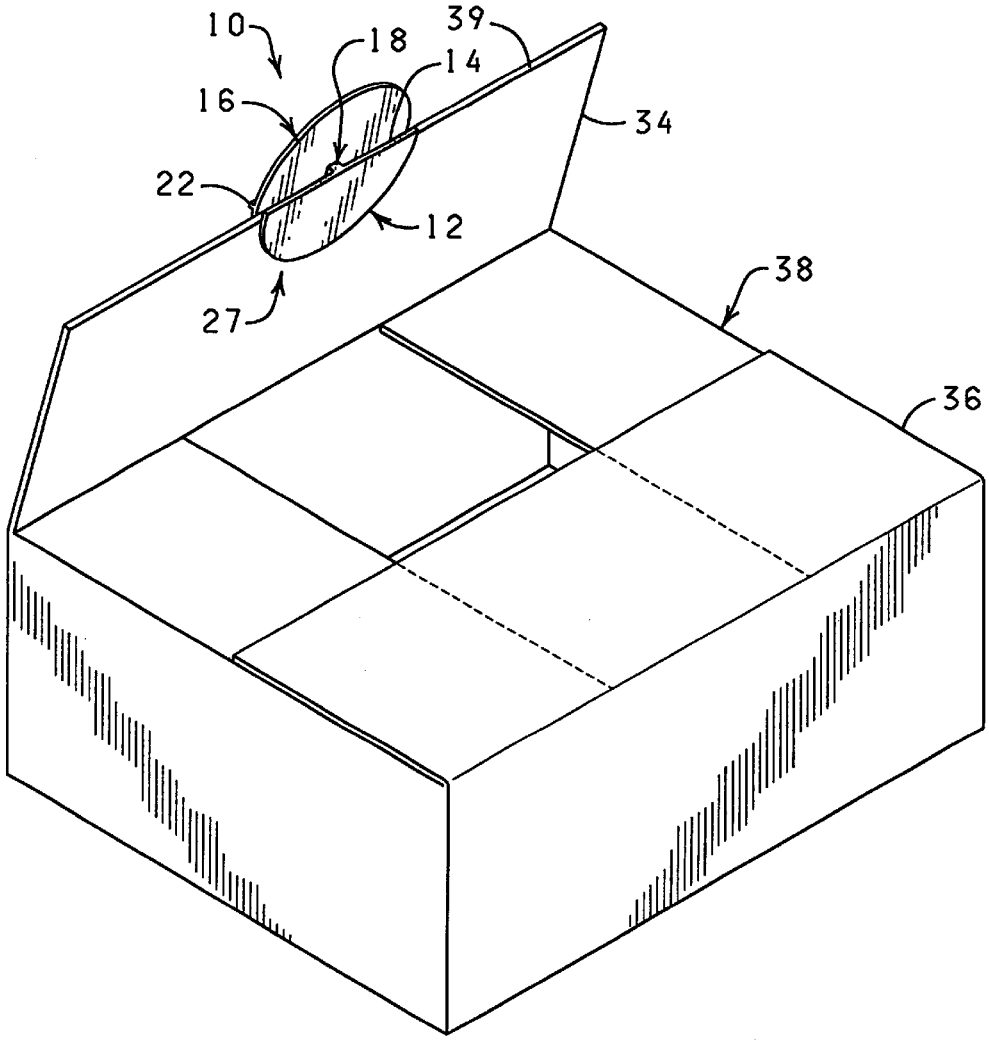
FIG. 2 is a perspective view depicting one inwardly extending box flap inserted into a box flap receiving slot provided in the box flap securing device of FIG. 1.
Figure 3:
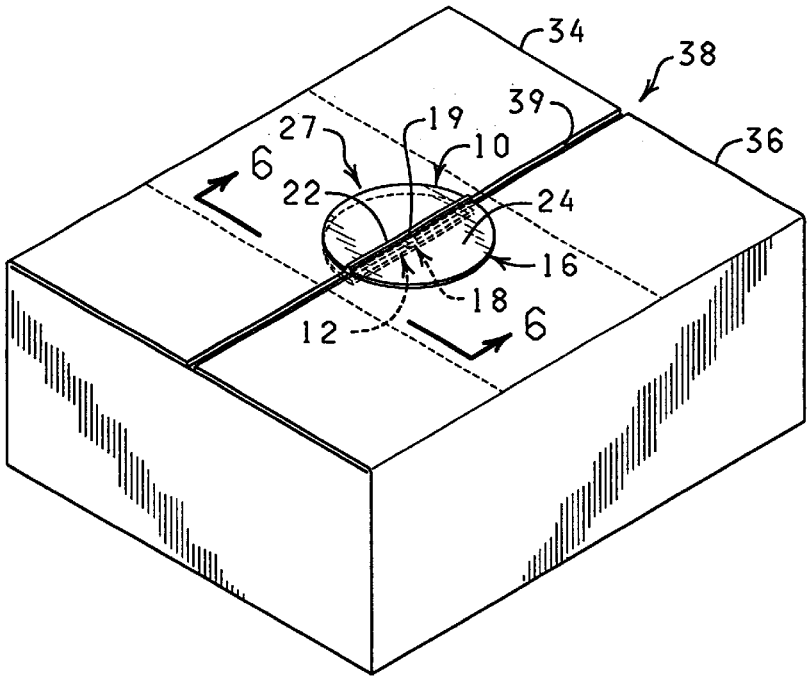
FIG. 3 is a perspective view which is identical to that depicted in FIG. 2, except that the box flap securing device and the inserted box flap have been moved downwardly to a closed position.

Referring more specifically to FIG. 2, the box flap 34, which extends upwardly and angularly away from the remainder of the box 38, is inserted in the box flap receiving slot 26 until the edge of the box flap 34 engages the post 18 and the edge 14 of the bottom member 12 is disposed about parallel with the edge of the box flap 34. In this position, at least a portion of the top member 16 extends a distance outwardly from an inner edge 39 of the box flap 34. The box flap 36 is then positioned near the closed position of the box flaps 34 and 36. Once the box flap 36 is positioned near the closed position, the box flap securing device 10 and the box flap 34 on which the box flap securing device 10 is disposed is moved in a downward direction as indicated by an arrow 40 in FIG. 5. As the box flap securing device 10 and the box flap 34 are being moved, the portion of the top member 16 extending outwardly from the inner edge 39 of the box flap 34 extends over and engages a portion of the box flap 36 and the continued motion thereafter moves the box flaps 34 and 36 to the closed position. As best shown in FIG. 6, the box flaps 34 and 36 are disposed in a substantially coplanar relationship and abuttingly engage opposite sides of the post 18 when the box flaps 34 and 36 are in the closed position. Further, in this position the top member 16 overlies portions of both of the box flaps 34 and 36, and the bottom member 12 underlies only a portion of the box flap 34. The box flap securing device 10 can then be selectively rotated a predetermined amount in either a clockwise or a counter-clockwise direction, as shown in FIGS. 4 and 7, so that the bottom member 12 underlies portions of the box flaps 34 and 36, and the top member 16 overlies portions of the box flaps 34 and 36. In one preferred embodiment of the present invention, the box flap securing device 10 can be rotated either clockwise or counter-clockwise about 90° if desired or until the box flap 34 and the box flap 36 are both disposed in the box flap receiving slot 26, for example. Once the box flap securing device 10 is installed in this position, the box flap securing device 10 effectively secures the opposing box flaps 34 and 36 in the closed position.

It should be noted that the post 18 is provided with a substantially rectangular cross-section. The rectangular cross-section causes the post 18 to frictionally engage a portion of the box flaps 34 and 36 to provide resistance to unintended rotation of the box flap securing device 10. This resistance in effect provides the box flap securing device 10 with a "child proof" locking device to prevent children from obtaining access to the interior of the box 38.

It should also be noted that the operation of the box flap securing device 10 is simplified because the edges 14 and 20 of the bottom member 12 and the post 18 are positioned coextensively, as previously discussed. That is, when the edge 20 of the post 18 is positioned coextensively with a portion of the edge 14 of the bottom member 12, the box flap 34 carrying the box flap securing device 10 can be moved downwardly into the closed position without the additional step of first lifting the box flap 36.

To provide a thin and compact box flap securing device 10 so that boxes 38 which are closed by respective box flap securing devices 10 can be easily stacked one on top of the other, the bottom member 12 and the top member 16 of the box flap securing device 10 can be spaced a distance apart which is greater than the thickness of one of the box flaps 34 and 36, as long as such distance is less than two times the thickness of the respective box flaps 34 and 36. In this embodiment, the particular spacing between the top member 16 and the bottom member 12 prevents the box flap securing device 10 from being utilized to directly connect more than two adjacently disposed box flaps.

Although the top member 16 of the box flap securing device 10 has been shown and described herein as having a generally circular configuration, it should be understood that in some embodiments of the present invention the top member 16 can be provided with other configurations, such as rectangular or octagonal configurations.

Although it is preferred that the bottom member 12 have a semi-circular configuration so as to include the planar edge 14, in some embodiments of the present invention the bottom member 12 can be provided with other configurations so long as the edge 20 of the post 18 and the edge 14 of the bottom member 12 remain in the coextensive relationship as previously discussed herein with reference to FIG. 1.

Figure 8:
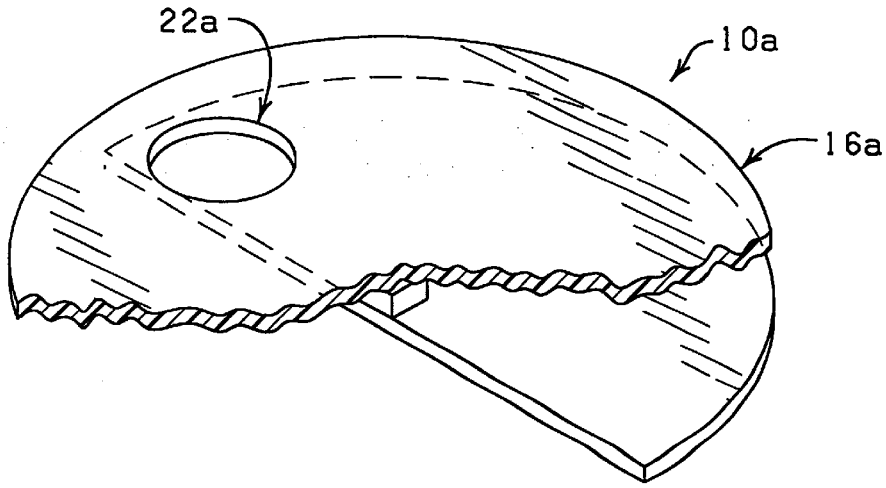
FIG. 8 is a fragmental, perspective view of a second embodiment of a box flap securing device constructed in accordance with the present invention.
Figure 9:
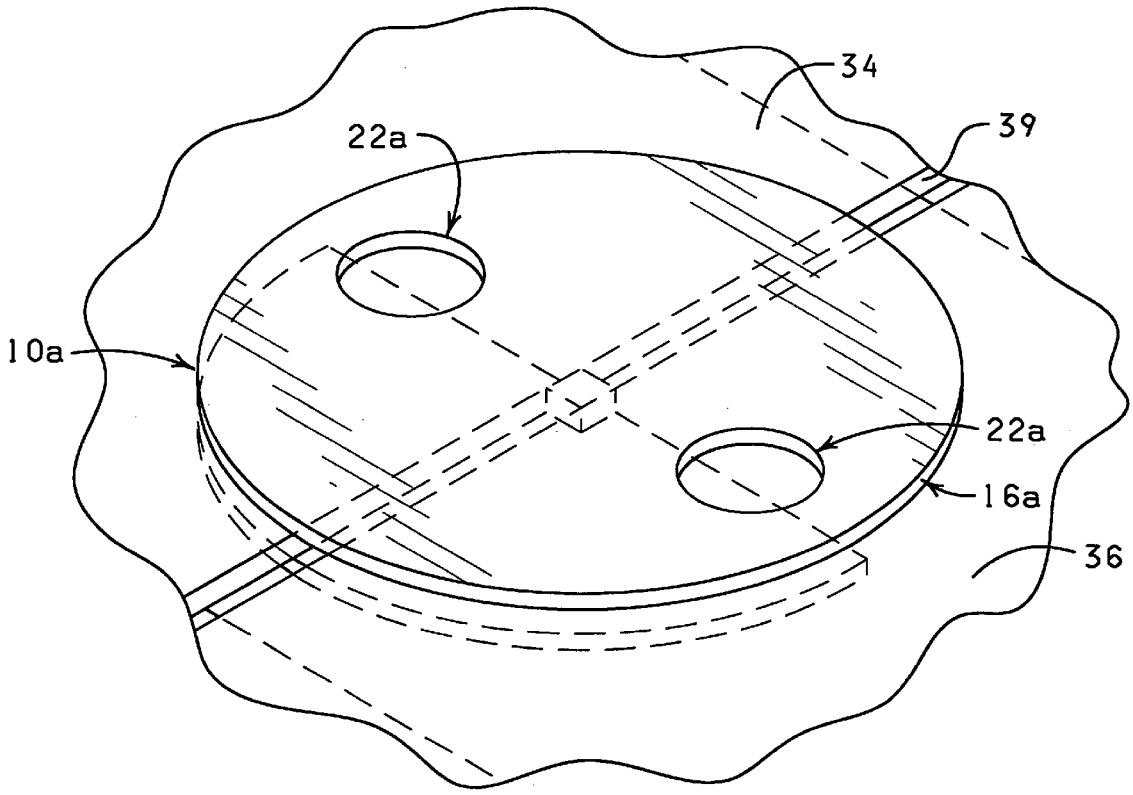
FIG. 9 is a fragmental, perspective view of the box flap securing device depicted in FIG. 8, disposed on two opposing box flaps of a box to maintain the box flaps of the box in the closed, secure position.

Referring now to FIG. 8, shown therein and designated by the general reference number **10*a* is a second embodiment of a box flap securing device constructed in accordance with the present invention. The box flap securing device 10*a* is constructed and functions identically to the box flap securing device 10, except that the gripping device 22 formed by the ridge has been eliminated and a gripping device 22*a* formed by a pair of opposing finger holes extending through a top member 16*a* have been provided. The finger holes of the gripping device 22*a* facilitate the-rotating of the box flap securing device 10***a* by insertion of respective fingers (not shown) therein.

Changes may be made in the combinations, operations, and arrangements of the various parts and elements described herein without departing from the spirit and the scope of the invention as defined in the following claims.

What is claimed is:

1. A box flap securing device for securing two opposing box flaps of a box in a closed position, the box flap securing device comprising:

a bottom member having an edge;

a top member;

a post connected to the bottom member and to the top member to maintain the top member a distance from the bottom member and in an overlying relationship with the bottom member such that the bottom member, top member and post cooperate to define a box flap receiving slot sized to receive one of the opposing box flaps, the top member being positioned with respect to the bottom member whereby one of the opposing box flaps can be inserted into the box flap receiving slot and whereby the inserted box flap and the box flap securing device can then be moved to the closed position so that the box flap securing device can be selectively rotated to secure the box flaps in the closed position, the post having a rectangular cross-section.

2. A box flap securing device as defined in claim 1, wherein the top member and the bottom member are spaced a distance apart which is less than two times the thickness of one box flap.

3. A box flap securing device as defined in claim 1, wherein the edge of the bottom member has a planar configuration.

4. A box flap securing device for securing two opposing box flaps of a box in a closed position, the box flap securing device comprising:

a bottom member having an edge;

a top member;

a post connected to the bottom member and to the top member, the top member being disposed in an overlying relationship with the bottom member whereby the bottom member, top member and post cooperate to define a box flap receiving slot sized to receive one of the opposing box flaps, the post having a rectangular cross-section at a location positioned to engage at least one box flap.

5. A box flap securing device as defined in claim 4, wherein the edge of the bottom member has a planar configuration.

* * * * *